United States Patent [19]

Camp

[11] 4,369,807

[45] Jan. 25, 1983

[54] PROTECTIVE FIRE HYDRANT GUARD

[76] Inventor: John P. Camp, 8717 Hopewell Dr., El Paso, Tex. 79925

[21] Appl. No.: 174,401

[22] Filed: Aug. 1, 1980

[51] Int. Cl.[3] ..... F16K 35/06; E03B 9/06; E03B 9/14

[52] U.S. Cl. ..... 137/296; 137/382; 137/800; 220/85 P

[58] Field of Search ..... 137/296, 377, 381, 382, 137/382.5, 371, 800; 220/85 P, 286, 284, 285

[56] References Cited

U.S. PATENT DOCUMENTS

| | | | |
|---|---|---|---|
| 2,118,233 | 5/1938 | Ruggio | 137/296 |
| 3,453,655 | 7/1969 | Quinones et al. | 137/296 |
| 3,626,961 | 12/1971 | Quinones | 137/296 |
| 3,709,249 | 1/1973 | Diaz | 137/296 |

FOREIGN PATENT DOCUMENTS

| | | | |
|---|---|---|---|
| 619436 | 9/1935 | Fed. Rep. of Germany | 137/296 |

*Primary Examiner*—George L. Walton

*Attorney, Agent, or Firm*—Mawhinney & Mawhinney & Connors

[57] ABSTRACT

The operating stem of a hydrant is protectively surrounded by a steel collar which upstands considerably above such stem so that only a special deep socket for a wrench can be used to engage and turn the stem. When the hydrant is without a weather guard the collar is fixedly welded directly to the bonnet and has side openings to permit solid objects and water to escape from within and not interfere with the turning of the stem. Where the hydrant has a weather guard, a flanged adapter is welded directly to the bonnet to cover the weather guard and the collar has a flanged lower end whereby it is held in place axially by the adapted but is free to rotate.

2 Claims, 6 Drawing Figures

PROTECTIVE FIRE HYDRANT GUARD

BACKGROUND OF THE INVENTION (1) Field of the Invention

The present invention generally appertains to improvements in fire hydrants and more particularly relates to a new and novel guard arrangement for preventing unauthorized turning of the operating stem for the valve control rod and, in the instance of hydrants with weather guards, protecting such weather guards from unauthorized operation.

(2) State of the Art

Most urban areas have a fire fighting hydrant system and the unauthorized opening of one fire hydrant can cause a sometimes very critical loss of adequate water pressure in the system. This has long been recognized and, consequently, many attempts have been made to combat vandalism and prevent unauthorized turning of the valve control rod. In such instances, the aim has been to control and permit only authorized turning of the operating stem which projects above the bonnet or hood on top of the stand pipe.

For example, in U.S. Pat. Nos. 3,840,041 and 3,916,939, magnetic type arrangements of rather complicated construction have been disclosed. Such arrangements require major modification of the hydrant and, of course, suffer from the deficiency that loss of magnitism of the magnitized parts would render such mechanisms useless.

Another type of arrangement is shown in U.S. Pat. No. 4,033,372 wherein a very elaborate device is provided to protect the hydrant stem and includes a hood or dome that fits over the entire top of the hydrant including the stem. The protective dome is held in place by legs bolted to the hydrant. Such bolts could be easily removed, thereby permitting the entire device to be removed from the hydrant by one not authorized to do so. Further, the arrangement consists of many specially made parts and suffers from the disadvantage that the hood or dome which fits over the bonnet of the hydrant must be made in various sizes since there are numerous bonnet sizes presently in use.

Another prior device is shown in U.S. Pat. No. 2,118,233 wherein a protective collar encircles the stem with the collar being fixed to the bonnet by legs that are attached to the bonnet fixing bolts of the hydrant. The attaching legs are inadequate to hold the collar in place because the removal of one or more bolts would permit the complete removal of the device from the hydrant bonnet. Such removal could be easily carried out by an unauthorized person.

In U.S. Pat. No. 3,453,655, a device is shown wherein a collar is built around the hydrant stem. However, such collar will still permit unauthorized access by use of an ordinary type of wrench to the stem and the device involves a rather complicated method of modifying the hydrant stem so as to permit installation of a positive locking device.

As can be appreciated, the devices of the prior art, as exemplified by the forgoing patents, are very complicated and most expensive so that they really possess no practical value for installation on hydrants, regardless of the configurations or constructions of the hydrants, on a large scale basis. And, only if every hydrant in an urban area can be protected will the entire fire-fighting hydrant system be maintained in proper operation so that there will always be a sufficient water pressure in such system.

SUMMARY OF THE INVENTION

The primary object of the present invention is to overcome the drawbacks of the known devices by providing a very sinple, structurally uncomplicated arrangement for protecting the valve operating stem of a hydrant against unauthorized engagement and also for protecting the weather guard whereby the hydrant is constantly protected against vandalism.

An equally important object of the present invention is to provide a guard arrangement which can be attached to any type of hydrant, regardless of the configuration or arrangement of the bonnet thereof, and which is so fixedly attached to the bonnet or hood of the hydrant that it cannot be removed and which so protects the operating stem that a special deep socket must be used to engage and turn the operating stem.

The present invention is in the form of an arrangement that encloses the operating stem in a manner so that the stem is protectively encircled and lies deep within the protective enclosure whereby a conventional wrench cannot be used to engage and turn the operating stem.

In particular, the protective device is in the form of a steel collar which, in the instance where the hydrant is without a weather guard, has its lower open end fixedly welded directly to the bonnet in a manner to encircle the stem and upstand well above the top of the stem so that only a specially constructed deep socket can fit within the collar to engage the stem. The protective collar is provided with side openings so that solid objects, such as stones, dirt or the like, and water can be freely discharged from the interior of the collar and thus not interfere with the socket engagement of the stem.

In the instance where the hydrant is provided with a weather guard, the collar is formed with a flanged lower end and a flanged adapter is provided and is fixedly welded to the bonnet about the weather guard with the collar disposed within the adapter and having its flange engaging the flange of the adapter so as to hold the collar against axial withdrawal but permitting free rotation thereof. The adapter encircles the weather guard in its welded attachment to the bonnet.

DESCRIPTION OF THE PREFERRED EMBODIMENTS

Figure 1:
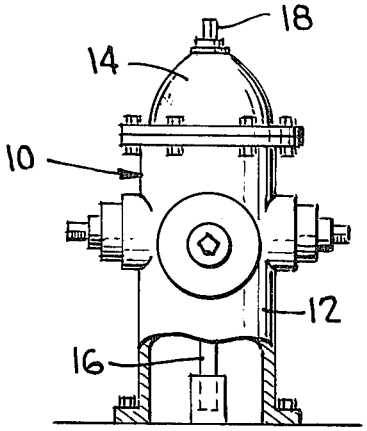
FIG. 1 is an elevational view of a conventional hydrant.

A conventional hydrant 10 is shown in FIG. 1 and such hydrant includes a pipe stand 12 having an upper end on which a bonnet or hood 14 is bolted with an operating stem 16 extending through the upper end of the bonnet and terminating in a nut end 18 normally pentagonal in shape which is adapted, in the case of conventional hydrants, to be engaged by any type of conventional wrench. A rotation of the nut by a suitable wrench causes rotation of the control rod 16 so as to open and close a valve means for activating and non-activating the hydrant.

Figure 2:
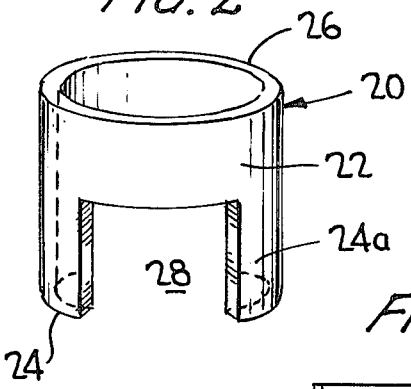
FIG. 2 is a prospective view of a guard, formed in accordance with the present invention, for use on a hydrant which does not have a weather guard.
Figure 3:
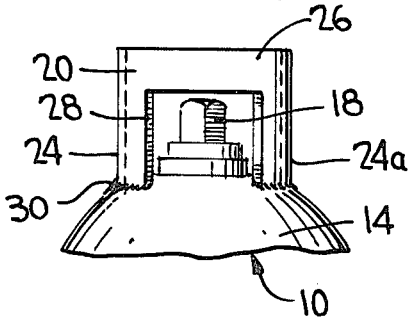
FIG. 3 is a fragmentary elevational view showing the guard of FIG. 2 in fixed attachment to the upper portion of the bonnet in its protective encirclement of the operating stem.
Figure 4:
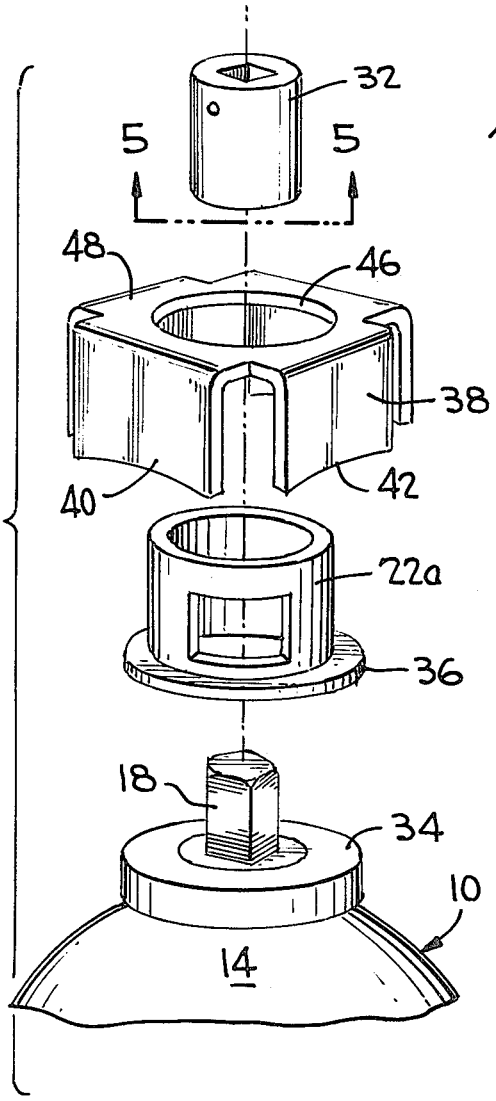
FIG. 4 is an exploded prospective view of a modified form of guard for use with a hydrant with a weather guard.
Figure 5:
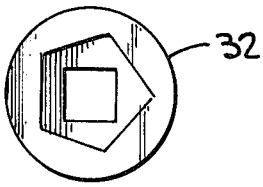
FIG. 5 is an end elevational view of the special deep socket of the present invention and is taken substantially on line 5—5 of FIG. 4.

In accordance with the present invention, a protective guard 20, as shown in FIGS. 2 and 3, is provided, for use in the instance where the hydrant does not have a weather guard. The protective guard 20 includes a steel collar 22 which has a lower open end 24. The collar 22 is formed in its lower end portion 24*a* with cut-outs or openings 28. As shown in FIG. 3, the collar is fitted around the nut end 18 of the operating rod or stem 16 in a radially spaced arrangement and the lower end 24 is securely fixed by welding 30 to the bonnet 14. The collar is fixed and is of such a dimension so that the upper end 26 extends well upwardly beyond the nut end 18 of the operating rod or stem. Consequently, the nut end 18 can only be engaged by a special deep socket 32, which is shown in FIG. 4. An ordinary socket wrench or other type of inventional wrench will not reach and engage the nut end of the stem so as to rotate the same. The special deep socket 32 is made to fit the pentagonal nut end 18 of the operating stem. The openings 28 are provided so that stones, debris and the like cannot accumulate in the interior of the guard around the stem and interfer with the actuation of the stem.

Figure 6:
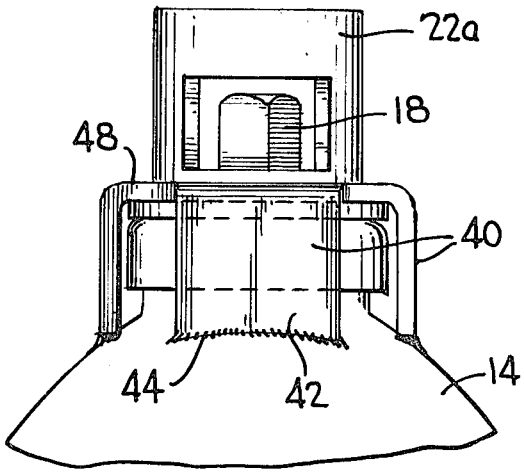
FIG. 6 is an elevational view showing the guard arrangement of FIG. 4 in fixed attachment to the bonnet of the hydrant.

In the instance where the hydrant is provided with a weather guard 34, as shown in FIGS. 4 and 6, the guard 22*a* is formed in its lower end with an outstanding annular flange 36 that is adapted to seat on the upper face of the weather guard 34. An adapter 38 is provided and is in the form of four spaced apart legs 40 having somewhat curved lower ends 42 that seat on the bonnet to which they are fixedly welded, as shown at 44 in FIG. 6. The adapter has an opening 46 through which the collar 22*a* extends with the opening being defined by an inturned flange 48 so that the flange 36 on the collar engages the inner face of the flange 48 whereby the collar cannot be axially withdrawn but yet is free to rotate. The adapter 38 fits around weather guard and protects the guard 34 and is welded to the bonnet. The inside of the flange 48 of the adapter fits over the flange 36 on the collar leaving the collar secure but free to rotate without opening the hydrant. Both the adapter and the collar are formed from hard steel, preferably 3/16" steel, so that neither will bend or break. The adapter is available in various depths so as to fit most standard hydrants.

Thus, as shown in FIG. 6, the nut end 18 of the operating stem is encased in steel and can only be opened by use of the special pentagonal deep socket 32 and the weather guard 34 is protected.

While the adapter 38 has been shown and described as being substantially a four legged or pronged member with the legs being separate from each other so as to provide the slots, it is envisioned that the adapter could be an annular or bell shaped body having a continuous circular bottom edge which would be welded in place and suitable opening arrangements or apertures could be provided in such body for the purpose of permitting an outgoing flow of debris or water.

It is believed that from the foregoing description, taken in conjunction with the attached drawing, the purpose, structural arrangement and operation of the protective devices will be quite clear. Of course such description and showings are merely exemplary of the invention which is only limited by the spirit and scope of the appended claims.

What is claimed is:

1. In combination with a fire hydrant having a stand pipe on which a bonnet is mounted and having a valve operating stem extending rotatably through the bonnet and terminating in a nut end above the bonnet, a protective arrangement for the nut end comprising a collar arrangement fixedly welded on the bonnet and surrounding the nut end and extending well above the nut end so that an ordinary wrench cannot engage the nut end with said collar arrangement having openings so that debris cannot collect around the nut end and a weather guard surrounding the nut end above the bonnet and said collar arrangement includes a flanged adapter welded to the bonnet around the weather guard, said collar being disposed within the adapter and extending upwardly therefrom and having an annular flange cooperating with the flange on the adapter whereby axial withdrawal of the collar is prevented while permitting free rotation of the collar without activating the hydrant.

2. The invention of claim 1 wherein said adapter and collar have openings radial to the stem nut end whereby debris cannot collect around the nut end.

* * * * *